US005627332A

United States Patent [19]

Lombardi

[11] Patent Number: 5,627,332

[45] Date of Patent: May 6, 1997

[54] DRUM BEATER AND PEDAL APPARATUS WITH INTERFITTING DUAL ADJUSTMENT OF DRUM RIM CLAMP

[76] Inventor: Donald G. Lombardi, 2118 E. Hillcrest Dr., Thousand Oaks, Calif. 91360

[21] Appl. No.: 650,370

[22] Filed: May 20, 1996

Related U.S. Application Data

[63] Continuation-in-part of Ser. No. 354,212, Dec. 12, 1994, Pat. No. 5,578,777, which is a continuation-in-part of Ser. No. 190,499, Feb. 2, 1994, Pat. No. 5,396,826, which is a continuation-in-part of Ser. No. 35,065, Mar. 22, 1993, Pat. No. 5,361,670, which is a continuation of Ser. No. 783,864, Oct. 28, 1991, Pat. No. 5,204,485.

[51] Int. Cl.[6] ..... G10D 13/02

[52] U.S. Cl. ..... 84/422.1

[58] Field of Search ..... 84/422.1–422.4

[56] References Cited

U.S. PATENT DOCUMENTS

| | | | |
|---|---|---|---|
| 3,618,441 | 11/1971 | Fearns . | |
| 3,742,806 | 7/1973 | Zalmer . | |
| 3,968,718 | 7/1976 | Carver . | |
| 4,048,896 | 9/1977 | Calato et al. . | |
| 4,188,853 | 2/1980 | Bills . | |
| 4,538,499 | 9/1985 | Livingston . | |
| 4,691,613 | 9/1987 | Jacobson . | |
| 4,756,224 | 7/1988 | Lombardi . | |
| 4,890,532 | 1/1990 | Carlson . | |
| 4,945,803 | 8/1990 | Norwood . | |
| 5,204,485 | 4/1993 | Lombardi . | |
| 5,301,592 | 4/1994 | Johnston | 84/422.1 |
| 5,361,670 | 11/1994 | Lombardi . | |
| 5,365,824 | 11/1994 | Hoshino . | |
| 5,396,826 | 3/1995 | Lombardi . | |

FOREIGN PATENT DOCUMENTS

| | | |
|---|---|---|
| 62-201792 | 12/1987 | Japan . |
| 644147 | 2/1989 | Japan . |

*Primary Examiner*—David S. Martin
*Assistant Examiner*—Jeffrey W. Donels
*Attorney, Agent, or Firm*—William W. Haefliger

[57] ABSTRACT

A drum beating assembly that comprises a frame, including at least one pedestal; an axle carried by the pedestal to rotate relative thereto, the axle having an axis of rotation; a drum beater carried by the axle; a pedal operatively connected to the axle to rotate the axle and beater in response to pedal movement; the frame including a base plate, there being a clamp arm to clamp a drum rim, structure supporting the arm on the plate to pivot relative thereto, and clamp the rim, and a first adjustable member positioning the arm for pivoting; the extent of pivoting of the member being separately adjustable.

11 Claims, 10 Drawing Sheets

3
22c
21c
22a
21a
22
21
22b
21b
16
16b
16c
56a
61
58a
58c
60
15
19
18
14
54
42
59
58b
19c
49
12a
22d
16a
21d
56
17
11
46
12
35
41
31
13
10
3

DRUM BEATER AND PEDAL APPARATUS WITH INTERFITTING DUAL ADJUSTMENT OF DRUM RIM CLAMP

This application is a continuation-in-part of prior U.S. application Ser. No. 08/354,212 filed Dec. 12, 1994, now U.S. Pat. No. 5,578,777 which is a continuation-in-part of prior U.S. application Ser. No. 08/190,499 filed Feb. 2, 1994, now U.S. Pat. No. 5,396,826, which is a continuation-in-part of prior U.S. application Ser. No. 08/035,065 filed Mar. 22, 1993, now U.S. Pat. No. 5,361,670, which is a continuation of prior U.S. application Ser. No. 07/783,864 filed Oct. 28, 1991, now U.S. Pat. No. 5,204,485.

BACKGROUND OF THE INVENTION

This invention relates generally to drum beating apparatus having multiple beaters, and more particularly concerns the operation and mounting of such beaters.

There is need for mechanism allowing infinitely adjustable at-rest positioning of a drum beater relative to a drum surface.

There is also need for drum beating apparatus in which two beaters are located close to one another to strike the same drum surface, but wherein the two beaters are independently adjustable relative to a drum surface or surfaces, and operable by foot pedals located at different, separate positions. No prior apparatus meets this objective in the novel and unusually advantageous ways as now afforded by the present invention, incorporating unusually advantageous structural combinations and modes of operation.

SUMMARY OF THE INVENTION

It is a major object of the invention to provided improved drum beating apparatus meeting the above as well as other needs and objectives. Basically, the invention is embodied in a combination that includes:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm to clamp a drum rim, means supporting the arm on the plate to pivot relative thereto, and clamp the rim, and a first adjustable member positioning the arm for pivoting, f) the extent of pivoting of the member being separately adjustable, the assembly may also include:

g) a crank connected with the axle to rotate therewith, h) a return spring positioned to exert tension on the crank to yieldably resist axle rotation by the pedal, about the axis, i) and an infinitely adjustable connection between the spring and crank to allow adjustment of the position of spring tension exertion on the crank, about the axle axis, whereby the rest position of the beater relative to a drum surface may be infinitely adjusted.

As will be seen, the first adjustable member is a lever located to pivot the arm as the lever is pivoted; and the second adjustment is a rotatably adjustable part acting on the arm to vary its range of pivoting by the first adjustable member.

A further object includes provision of a second adjustment member to control the position of the arm relative to the plate and rim, whereby the extent of adjustment of the first member to effect arm clamping of the rim is reduced.

Accordingly, the two members may be adjusted so that any minimum movement of the clamp arm is required to clamp the rim.

Use of a single pedestal (i.e., elimination of a second pedestal) is provided for and provides more room for other percussion equipment, and saves overall weight.

Yet another object is to provide a double drum pedal apparatus in which a first pedal frame is provided with rotatable first and second beaters and a first pedal for rotating the first beater when pushed down; a second pedal frame being provided with a second pedal; the second beater having a supporting shaft operatively connected to the second pedal; and characterized in that the first pedal frame is provided with first, second and third bearing portions, the first beater having a supporting shaft supported by the first and second bearing portions, the shaft supporting the second beater being supported by the second and third bearing portions, whereby the second shaft is rotatable independently of the first shaft. Roller bearings are typically provided on the pedal frames to support the pedals for rotation, and such bearings may be replaceable as will be seen.

These and other objects and advantages of the invention, as well as the details of an illustrative embodiment, will be more fully understood from the following specification and drawings, in which:

DRAWING DESCRIPTION

DETAILED DESCRIPTION

Figure 1:
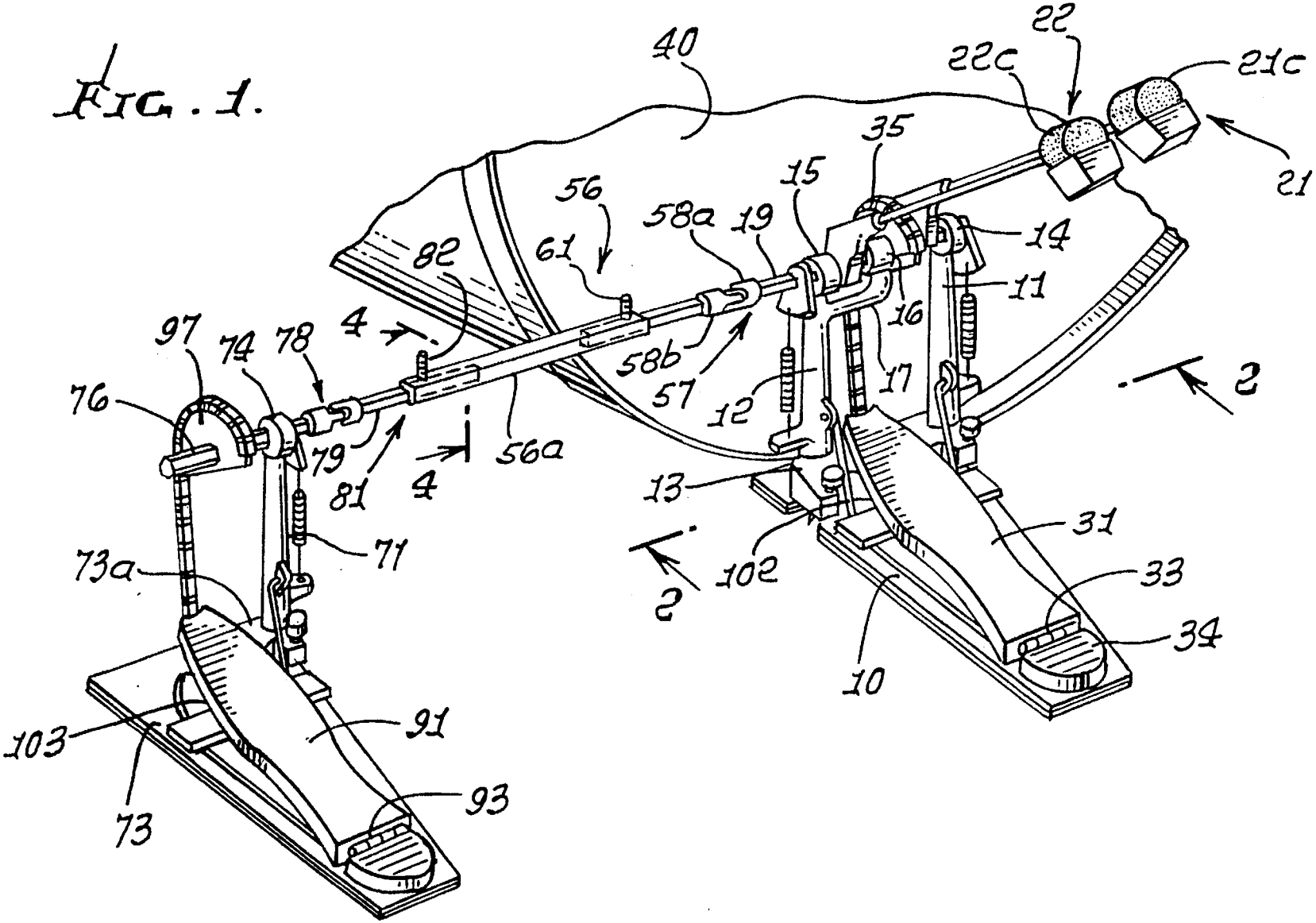
FIG. 1 is a perspective view of the apparatus incorporating the invention.

In the drawings, a first horizontal, longitudinally extending base plate 10 integrally supports a first frame that includes first pedestal means. Such pedestal means is shown to include laterally spaced, upright pedestals 11 and 12, the lower ends of which are carried by a bottom yoke 13 attached to a base plate forward portion. The upper ends of the pedestals carry first and second coaxial bearing sleeves 14 and 15, which are laterally spaced apart. The pedestal means also carries third bearing structure 16, and specifically, an arm 17 extends laterally rightwardly from pedestal 12, and upwardly, to support structure 16. The latter includes a bearing housing **16*a***, and two roller bearing parts 16*b* and 16*c* positioned in housing 16*a*, in laterally spaced relation. Arm 17 is elbow-shaped and is integral with 12 and 16*a*. A primary axle or shaft 18 is carried by the first and third bearings, and specifically, by bearing sleeve 14 and bearing part 16*b*; and a secondary axle or shaft 19 is carried by the second and third bearings, and specifically, by the bearing sleeve 15 and bearing part 16*c*, the axles 18 and 19 being independently rotatable, yet coaxial.

A primary drum beater 21 is carried by the primary axle 18, and a secondary drum beater 22 is carried by the secondary axle 19, whereby the two beaters are separately operable. Note that the beater 21 has a shaft 21*a* and a connector 2l*b* to axle 18; and beater 22 has a shaft 22*a* and a connector 22*b* to axle 19, both connectors laterally spaced, and located between the bearing sleeves 14 and 15 on the pedestals. See also the beater heads 21*c* and 22*c*. Axles 18 and 19 are polygonal to rigidly connect to the elements 2l*b* and 22*b*.

A first pedal 31 is operatively connected to the primary axle 18 to rotate that axle and the primary beater 21 in response to pedal pivoting effected by the foot of the drummer.

Figure 3:
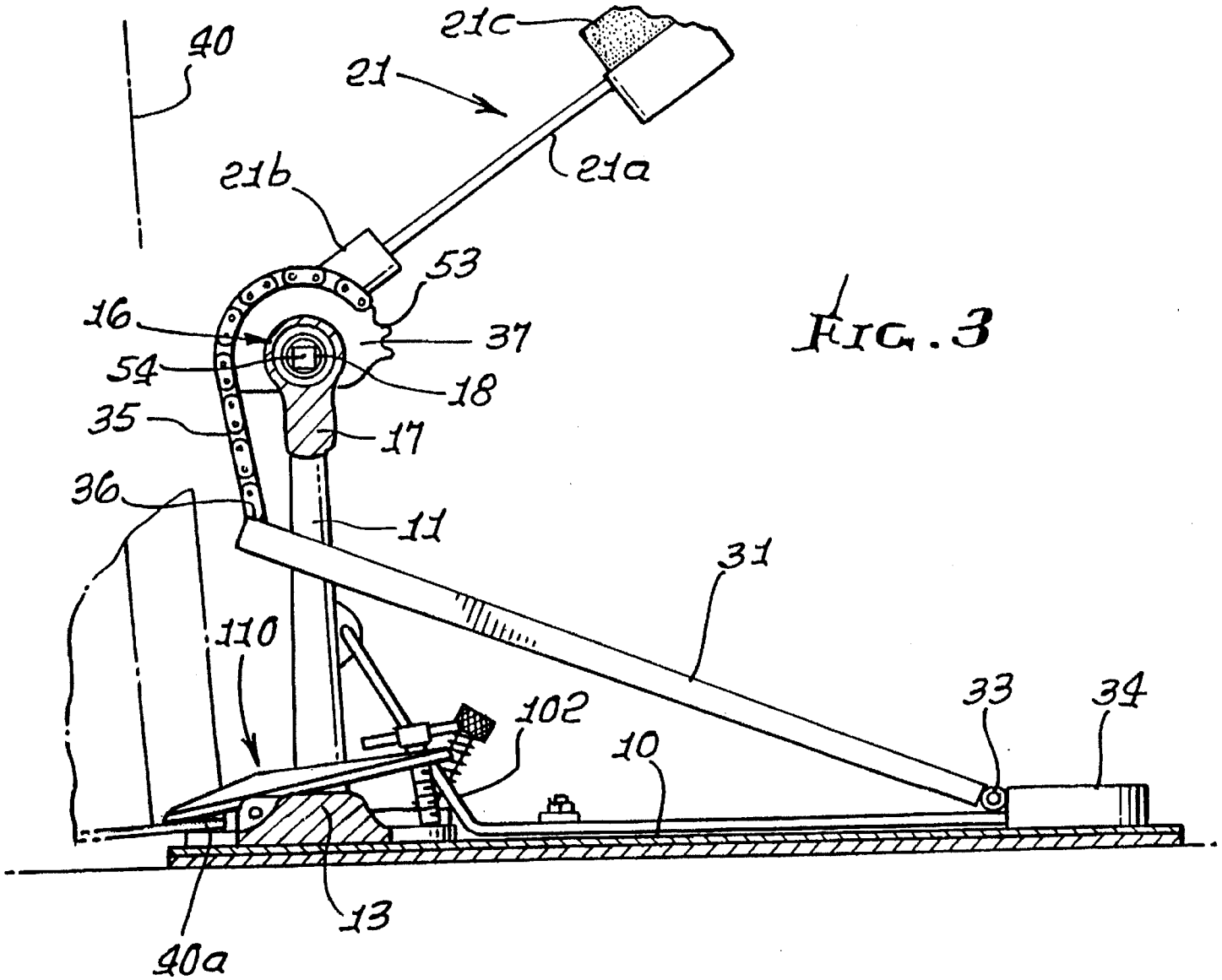
FIG. 3 is a section taken on lines 3—3 of FIG. 2.
Figure 4:
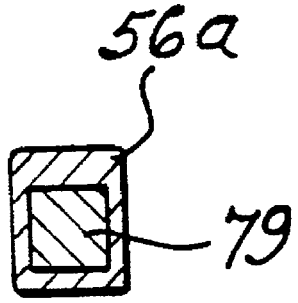
FIG. 4 is a section taken on lines 4—4 of FIG. 1.

In the FIG. 3 example, the pedal is pivoted at 33 to a heel support 34 attached to plate 10. Pivot 33 typically comprises roller bearing means, such as ball bearings, to reduce friction. A flexible coupling, such as chain 35, is connected at 36 to the forward end of the pedal, and extends upwardly to mesh with and wrap on sprocket 37. The latter is fixedly mounted on axle 18, whereby, as the pedal is pushed down, the sprocket and axle 18 are rotated, and the beater 21 rotates forwardly, so that head 21*c* strikes the drum surface indicated at 40. Yieldable means, such as tension spring 41 is operatively connected between the primary axle and the frame, such as the lower end of pedestal 11, to yieldably resist axle rotation, and return the beater to FIG. 3 position. Note that spring 41 has its upper end connected to crank 42 on shaft or axle 18.

A similar spring 46 is operatively connected between secondary axle 19 and the frame, such as the lower end of pedestal 12, to yieldably resist axle 19 rotation, to return secondary drum beater 22 to retracted position, as indicated in FIG. 3. That spring has its upper end connected to a crank 49 on shaft 19.

Axles 18 and 19 may have square cross sections to enable positive connection of the sleeve-type connectors 21*c* and 22*c* to the axles, set screws 21*d* and 22*d* also being provided. Annular bearings receive the axles for reception in the bearing sleeves 14 and 15.

The surface portions, including teeth 53 on the sprocket 37, may be located at progressively increasing radii from an axis 54 defined by axle 18, and located angularly about that axis, whereby those surface portions extend eccentrically relative to axis 54, as disclosed in U.S. Pat. No. 4,756,224. This causes the beater to travel progressively faster toward the drum surface, as the pedal is displaced downwardly at a fixed angular velocity.

The secondary axle 19 and secondary drum beater 22 may be rotatable by auxiliary means not mounted on plate 10. Such secondary means may, for example, include an elongated and elongatable rotary link 56 coupled to axle 19, as by coupling structure 57. The latter is shown to include universal joint members 58*a* and 58*b* rotatably interconnected by cross pin 58*c*. Member 58*a* is connected to the end 19*c* of axle 19 projecting away from the bearing 15; and member 58*b* is connected to a square cross section sub-shaft 59, as by transverse pin 60. Shaft 59 is also received in and connected to link member 56*a* via a coupling set screw 61, allowing extension of 56*a* and 59.

Figure 2:
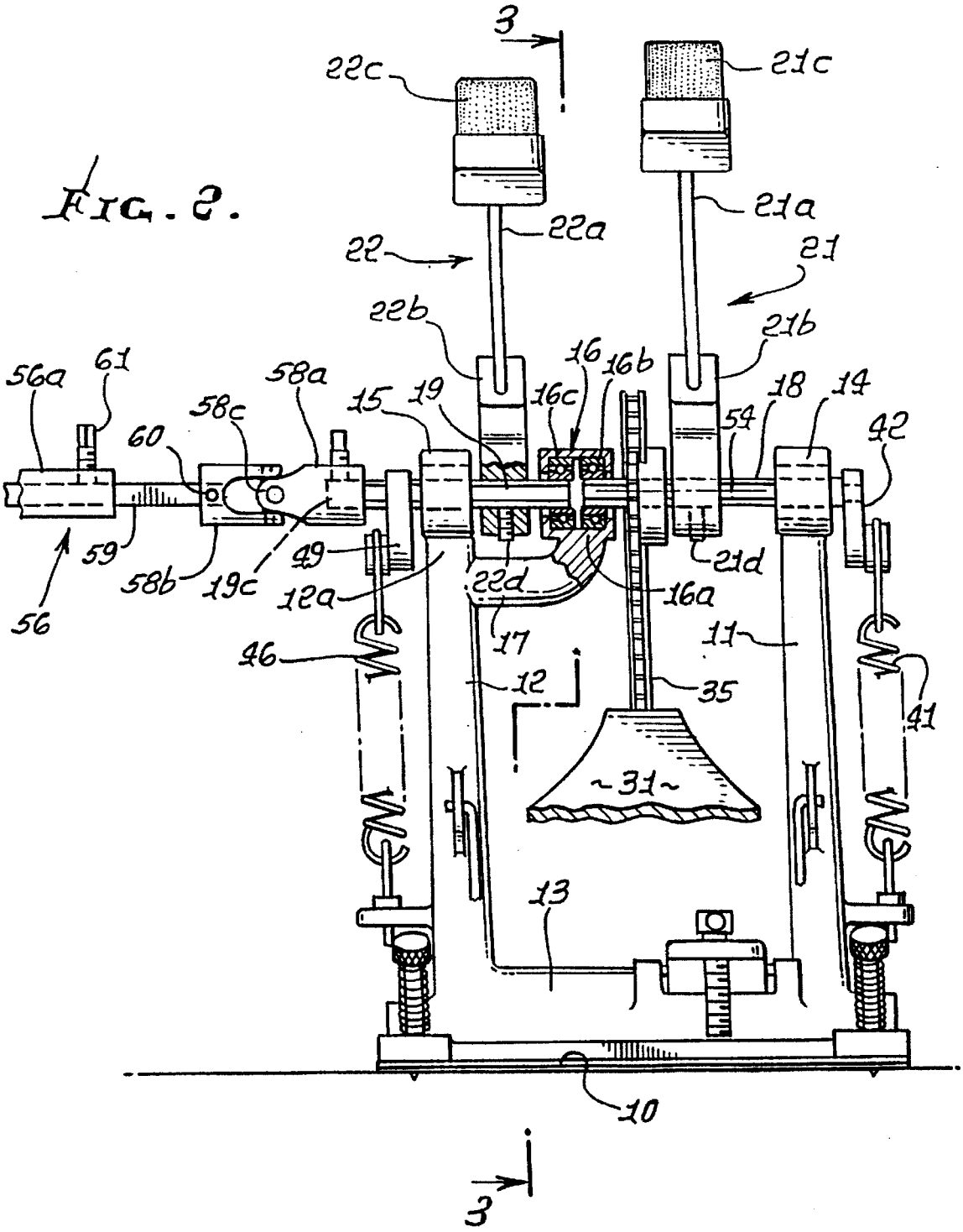
FIG. 2 is an enlarged section taken in elevation on lines 2—2 of FIG. 1.

Note that bearing 15 is coaxial with bearing 16, and carried by upper extension 12*a* of the pedestal. That upper extension 12*a* and arm 17 form a yoke, and between which beater 22 connector 22*b* is located. The two bearings 16*b* and 16*c* being separate may allow for some degree of axial mis-alignment of the axles 18 and 19, whereby each axle 18 and 19 is freely supported for rotation by only two bearings, yet the two beaters are located in close lateral relation, as seen in FIG. 2. Arm 17 is located above the pedal 31 so as not to interfere with it.

Figure 5:
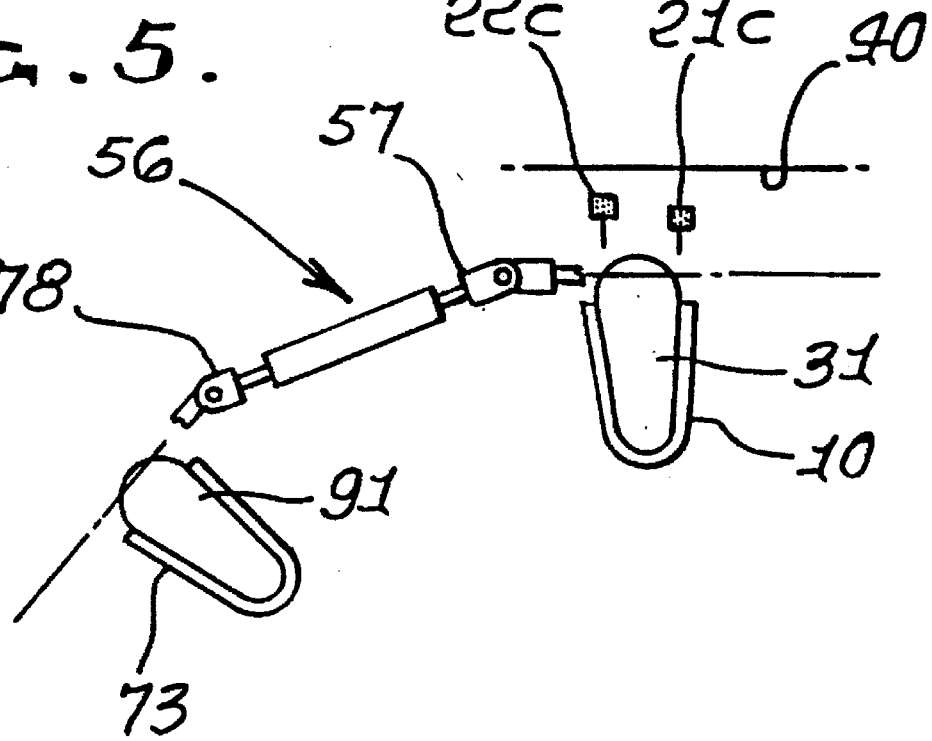
FIG. 5 is a diagrammatic view showing relative adjustability of two pedals on two base plates, in association with two drum beaters which have fixed relative positions.
Figure 6:
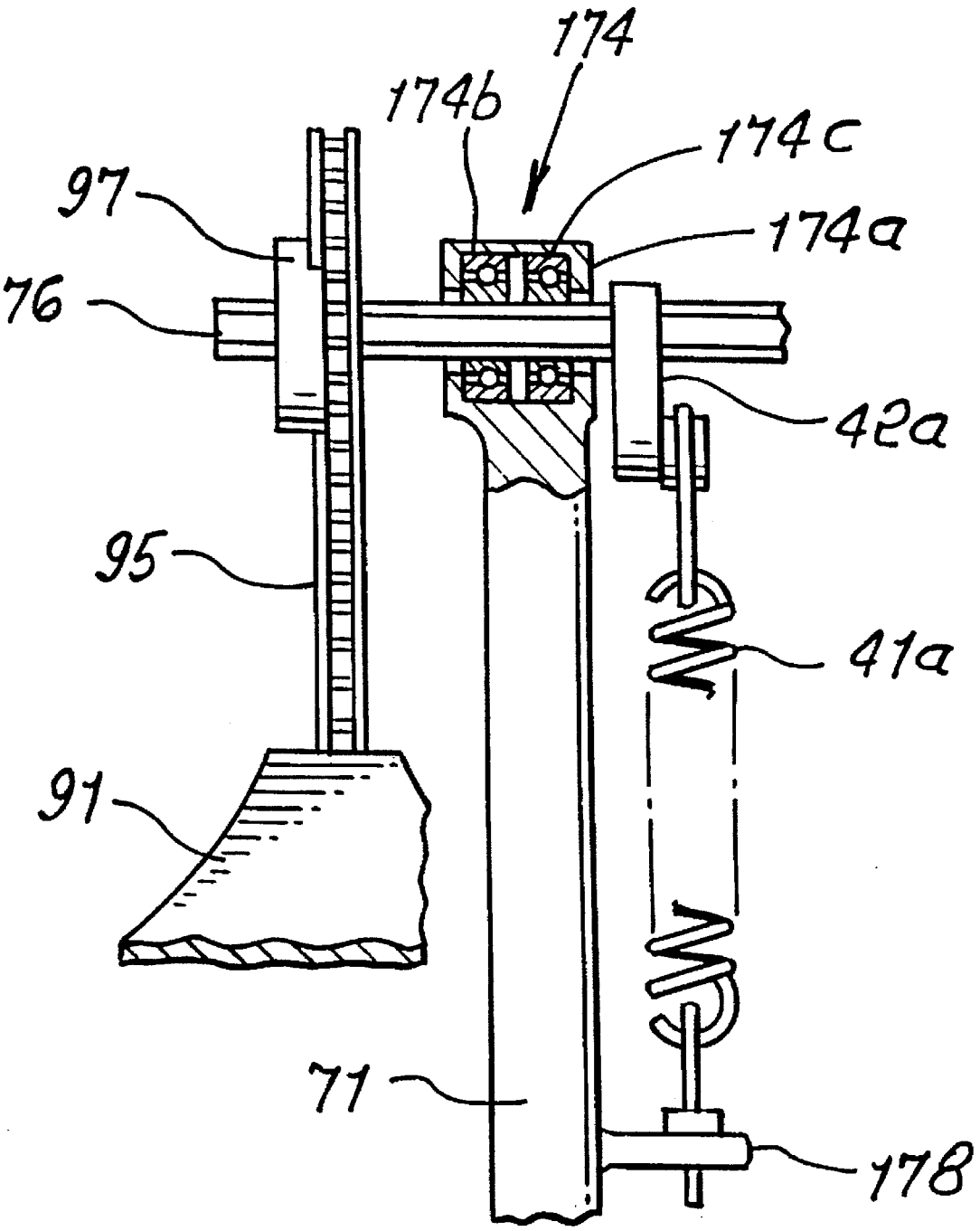
FIG. 6 is a fragmentary frontal view of the auxiliary pedal and single pedestal carrying the tertiary shaft.

FIGS. 1 and 6 show the provision of a second frame, including second pedestal means, such as single, upright pedestal 71. The latter is integrally mounted via bottom support 73*a* on a second base plate 73 which is independent of plate 10 and can be adjustably positioned at different locations relative to plate 10, to suit the drummer. See FIG. 5. Other bearing structure is carried by the second pedestal 71, and a tertiary axle or shaft 76 extends laterally and is shown as carried for rotation by the bearing 174. Link 56 is connected to tertiary axle 76 as by structure corresponding to structure 57. See for example universal joint 78, square cross section sub-shaft 79, and elongatable coupling 81. Set screws 82 and 61 are associated with the couplings 61 and 56 to adjustably grip the sub-shafts, allow complete disassembly or disconnection of the two axles 19 and 76, and the two base plates 10 and 73. Elongated link member 56*a* advantageously consists of lightweight metal, such as aluminum.

A pedal 91 is pivotally mounted at 93 on second base plate 73, and a flexible coupling, such as a chain 95, couples the forward end of the pedal 91 to a sprocket 97 attached to axle 76. Accordingly, the pedal 91 is coupled to the second beater 22 to rotate same, as pedal 91 is pushed downwardly. Plate or sprocket 97 may be eccentric, as described above, as respects sprocket 37. Holder members 102 and 103 also support the pedestals on the base plates, as shown.

As shown in FIG. 6, the bearing 174 includes a housing 174*a* and two roller bearing parts 174*b* and 174*c* positioned in housing 174*a*, in laterally spaced-apart relation. Single pedestal 71 supports bearing 174. A tension spring 41*a* and crank 42*a* are connected between the shaft 76 and lug 178 on the pedestal, to yieldably and resiliently return the shaft 76 and pedal 91, and beater 22, to initial rotary positions.

Accordingly, the invention in one of its aspects provides a first pedal frame with rotatable first and second beaters and a first pedal for rotating the first beater when pushed down; a second pedal frame being provided with a second pedal; the second beater having a supporting shaft operatively connected to the second pedal; and characterized in that the first pedal frame is provided with first, second and third bearing portions, the first beater having a first supporting shaft supported by the first and second bearing portions, the second shaft supporting the second beater being supported by the second and third bearing portions, whereby the second shaft is rotatable independently of the first shaft. There is also an additional shaft coupled to one of the first and second shafts, and a single pedestal on the second pedal frame and being the only pedestal supporting the additional shaft, saving weight and providing added space or room for other percussion equipment close to the drummer. A very simple adjustable pedal structure is thereby provided.

Adjustable clamp means 110 on the forward end of the plate 10 clamps to drum structure 40*a*, as shown.

Figure 7:
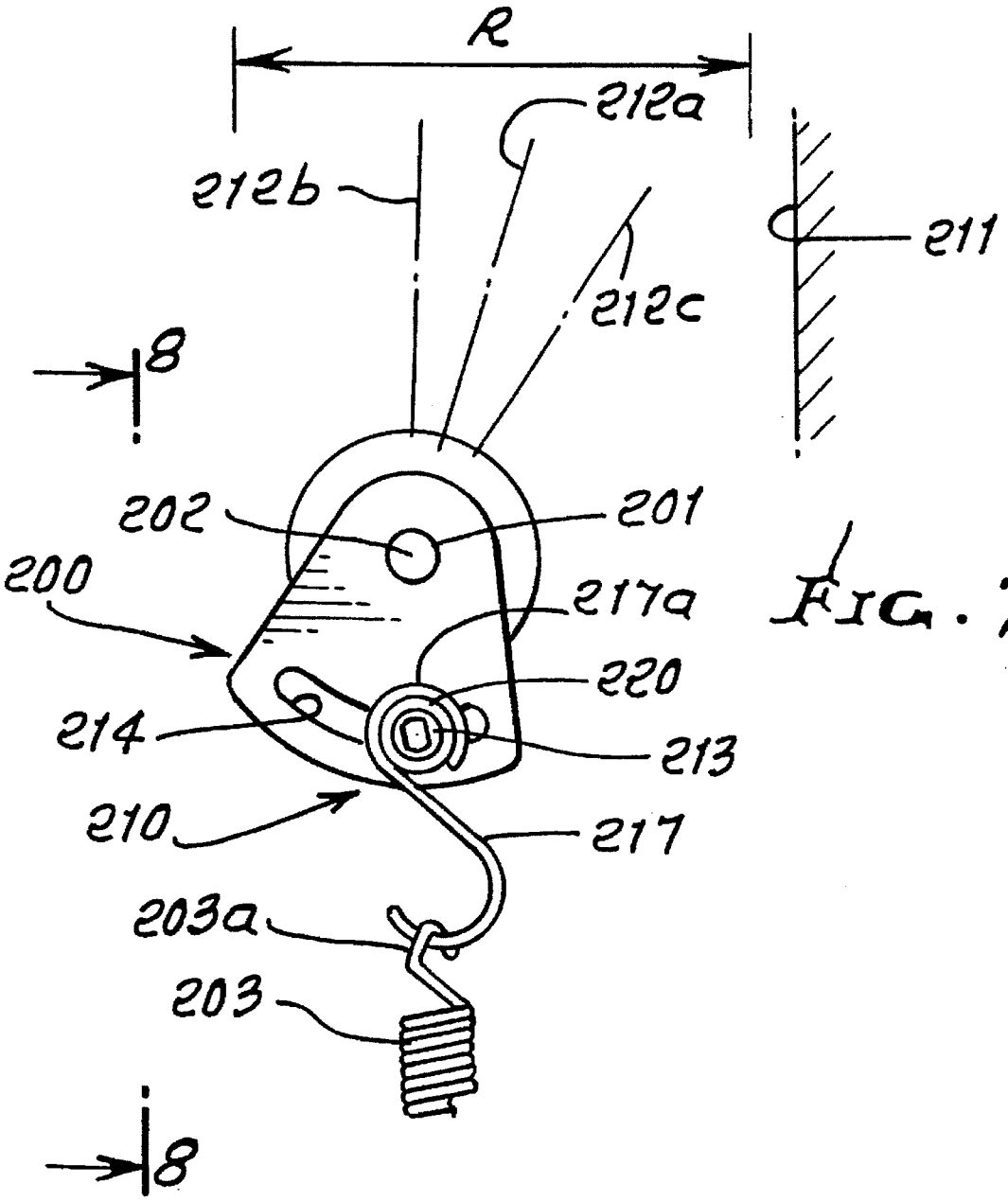
FIG. 7 is an enlarged side elevation showing an infinitely adjustable connection.
Figure 8:
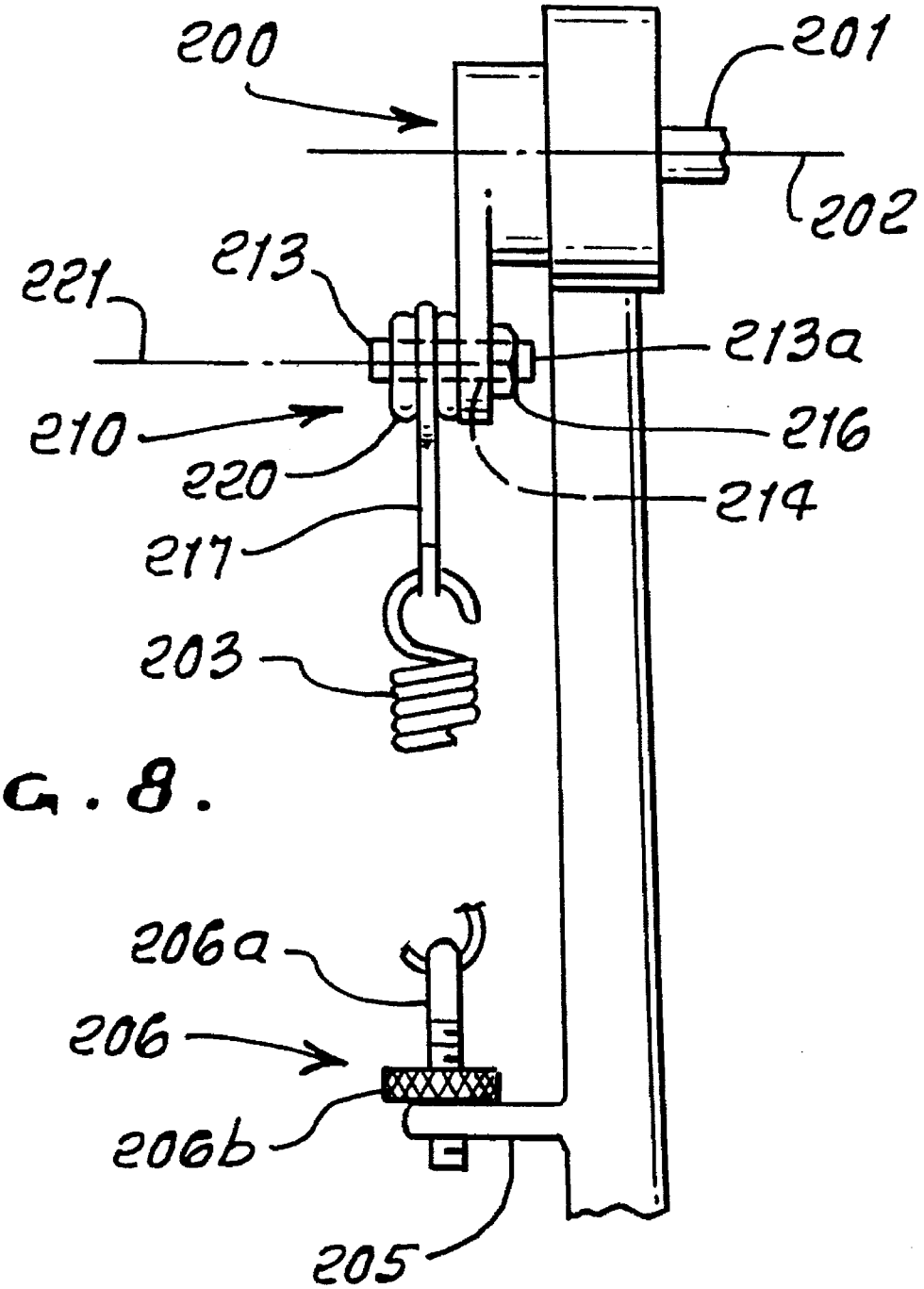
FIG. 8 is an elevation taken on lines 8—8 of FIG. 7.

Referring now to FIGS. 7 and 8, one or more of the cranks 42, 49 and 42*a* may have the form shown at 200, the axle to which the crank is connected indicated at 201, and the axes of axle and crank rotation being shown at 202. The return (tension) spring acting on the crank is shown at 203, and may represent any of the springs 41, 46, and 41*a*. One end of the spring is adjustably anchored to the pedal frame, indicated at 205. See threaded vertical axial adjustment 206 provided by a threaded shank 206*a* and an adjustable clamping nut 206*b*, whereby spring tension may be adjusted.

An invariably adjustable or variable connection is provided between the crank and the tension spring, as generally indicated at 210. Its purpose is to allow accurate, for example infinitely adjustable, at-rest positioning of the drum beater carried by the shaft 201, and relative to a drum surface indicated at 211. See for example the different at-rest positions of the beater at 212*a*, 212*b*, 212*c*, etc. in FIG. 7, and to which the beater may be adjusted. An infinite number of such beater positions may be selected within a selected range indicated, for example, by the dimension R.

The illustrative connection 210, which is preferred but of which there may be variations, include a tongue in the form of a fastener 213 having a shank 213*a* passing into or through a groove or slot 214 in the crank. Slot 214 is endwise elongated in an arcuate direction about axis 202, and so that fastener shank 213*a* may be shifted to any one of an infinite number of positions along the slot length. A nut 216 on a threaded portion of the shank 213*a* may be tightened to clamp, i.e., connect the fastener in selected position (about axis 202) to the crank. This fixes the point of spring force transmission to the crank, since the spring is attached to the fastener, as shown, via a hook 217 hook-shaped attached to spring end 203*a*, and the at-rest angularity of the crank and the beater are thereby selected. Loosening of the nut allows adjusted connection of the spring to the crank, as referred to.

A bearing, as for example a ball bearing unit 220, is carried by the fastener, to have its axis 221 in coincidence with the fastener shank axis, i.e., parallel to axis 202. The hook end 217*a* fits over the bearing, as shown.

Figure 9:
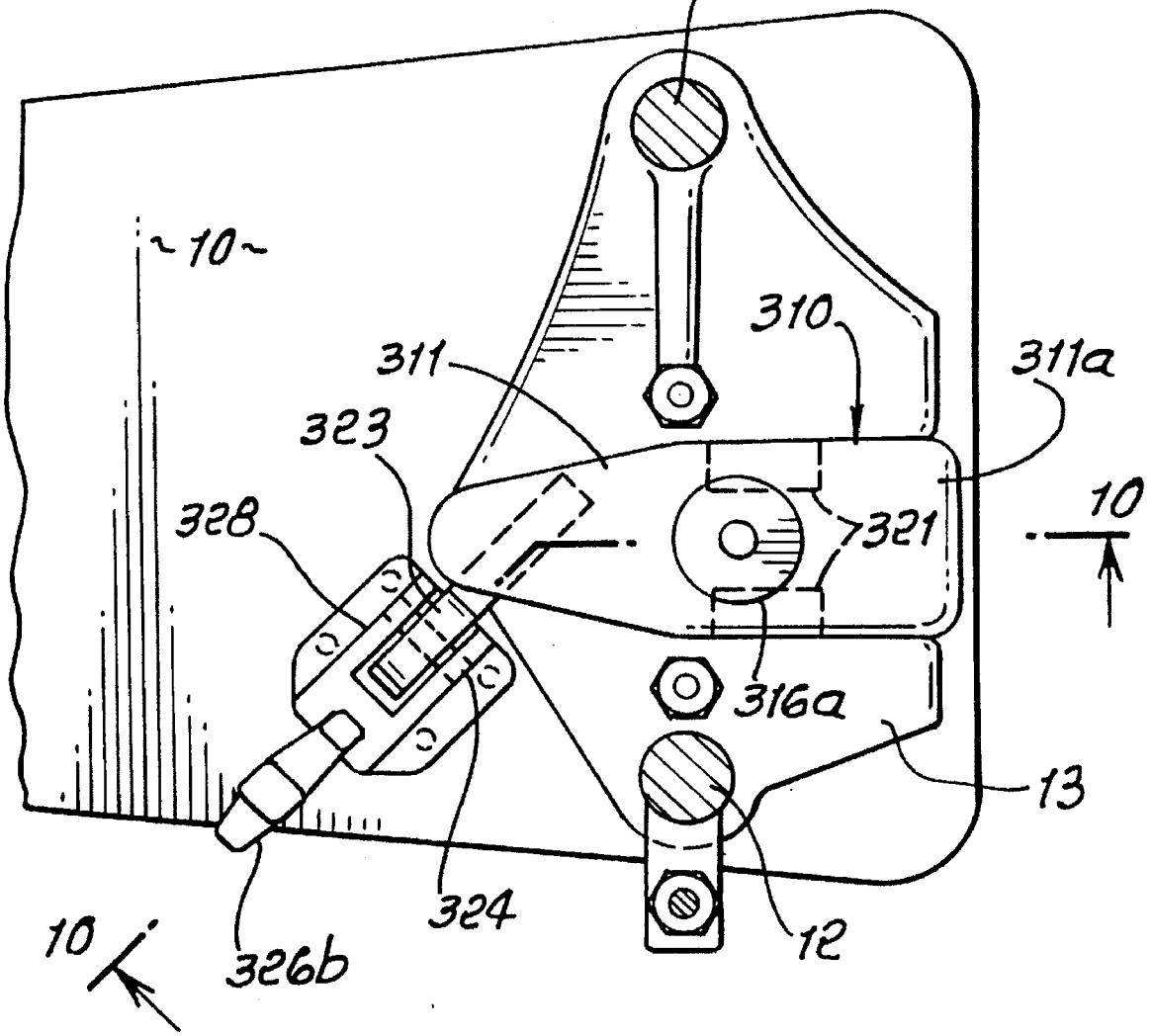
FIG. 9 is a top plan view of drum rim clamp adjustment apparatus.
Figure 10:
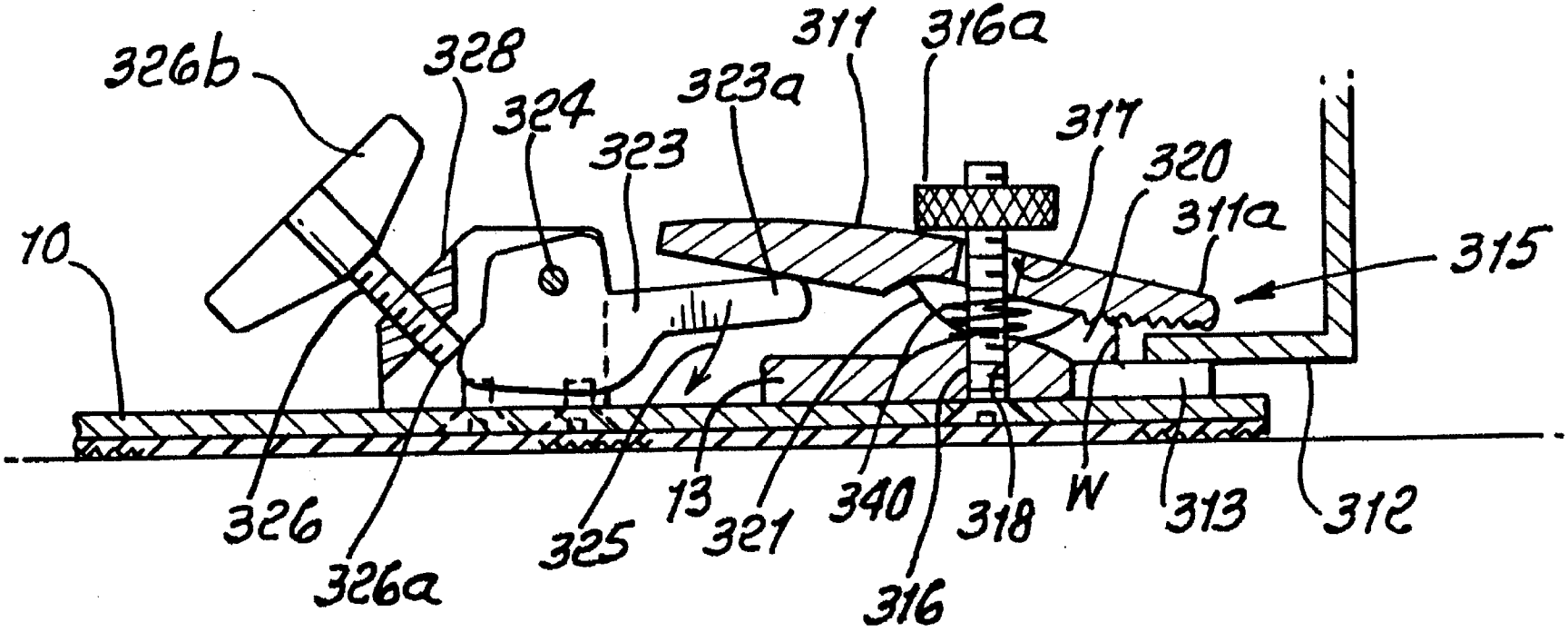
FIG. 10 is a section taken on lines 10—10 of FIG. 9.

In FIGS. 9 and 10, the means 310 to attach the base plate and pedal unit to a base drum rim corresponds to the previously shown such means 110 in FIG. 3. The base plate 10 and beater pedestal yoke 13 are the same as in FIG. 3. The clamp arm 311 has a forward end 311*a* adapted to project over the drum rim 312, and clamp it down against surface 313, associated with plate 10.

Means is provided to support arm 311 on the plate to pivot in a vertical plane, as indicated by arrow 315 in FIG. 10. Also, an adjustable member, such as screw fastener 316, is adapted to position the clamp arm 311 to pivot, as shown. Fastener 316 loosely projects with clearance downwardly through an opening 317 in arm 311, and into a threaded opening 318 in part 13, to allow turning of the fastener via knob 316*a* to adjust the height or level of the arm 311, relative to the base plate, but without preventing rocking or pivoting of the arm, as referred to. The width W of gap 320 is thereby adjusted. A rocker 321, or rockers, are integral with the arm 311, and project downwardly, as shown. A spring 340 urges arm 311 upwardly.

Also provided is another adjustable member 323 to control or adjust the pivot position of the arm 311 relative to the base plate and drum rim in gap 320. Member 323 is shown in the form of a lever pivoted at 324 to rock in a vertical plane, as indicated by arrow 325.

An adjustable set screw 326 bears at 326*a* against the lever to cause its end 323*a* to rise, effecting clamping of the drum rim as the set screw is tightened, as via turning of knob 326*b*. Structure 328 supports the screw, and the pivot at 324.

It will be seen that fastener 316 can be adjusted, so that only one or two turns of knob 326*b* are required to effect the rim clamping, which is of considerable advantage to minimize adjustment, in setting up the pedal apparatus to clamp to a bass drum. End-to-end located levels 311 and 323 are selectively angled, as seen in FIG. 9, for ease of access to adjustment knob 326*a*.

Figure 11:
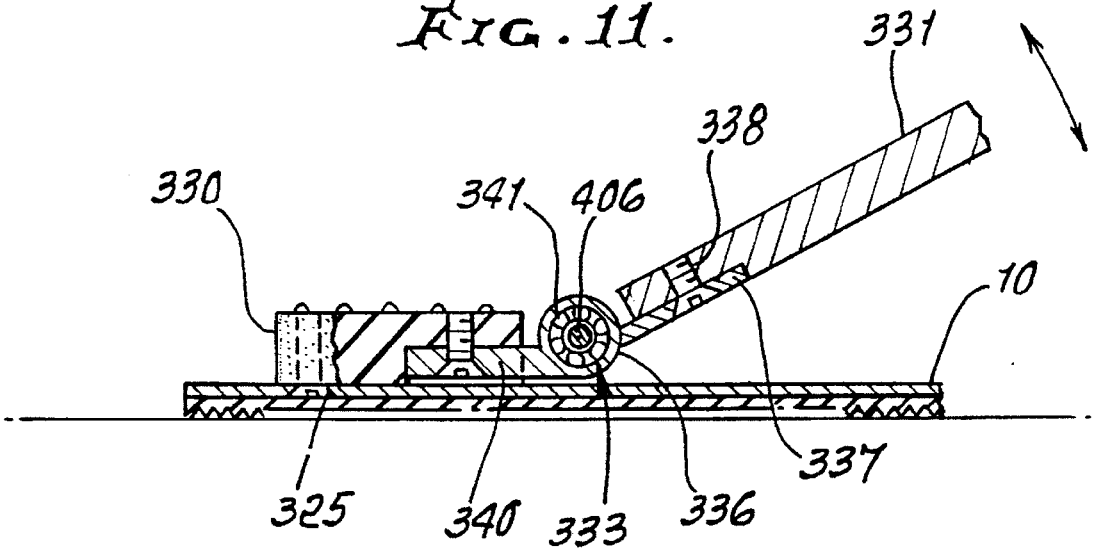
FIG. 11 is a vertical section through roller bearing support means for a pedal.

FIG. 11 shows provision of a heel pad 330 (corresponding to pad 34) attached at 325 to the plate 10. The rearward end of the pedal 331 is spaced forwardly of the pad. A roller bearing assembly 333 is located in association with the heel pad and the rearward end of the pedal, and connected thereto, to support the pedal for pivoting. See bearing housing 336 having an integral arm 337 attached at 338 to the underside of the pedal; and a bearing hub 339 having an integral arm 340 projecting into the heel plate and attached thereto. Bearing balls or rollers 341 are located in a ring, between inner and outer races defined by 336 and 339.

Figure 12:
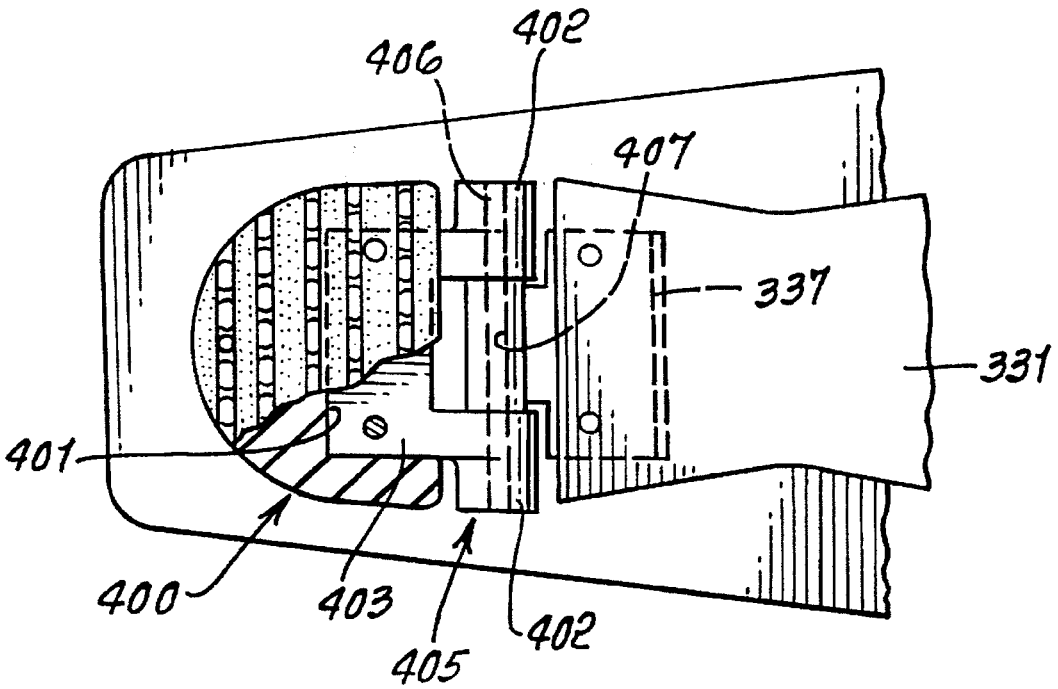
FIG. 12 is a top plan view of a modified bearing support.

FIG. 12 shows a modification in which the heel plate 400 has a recess 401 between two laterally spaced lugs 402. A tongue 403, attached to 402, is received in that groove. Ball bearings are housed between inner and outer races, received in the lugs, these assemblies indicated at 405. A bearing axle 406 is carried by the races, and a tongue 406*a* associated with axle 406 extends between lugs 402 and is carried by arm 337 attached to the heel plate. Axle 406 rotates in the bearings, as the pedal is swung by the drummer's shoe.

I claim:

1. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm to clamp a drum rim, means supporting the arm on the plate to pivot relative thereto, and clamp said rim, and a first adjustable member located to pivot said arm as said member is moved.

2. The combination of claim 1 including a second adjustment member to control the position of said arm relative to said plate and rim, whereby the extent of adjustment of the first member to effect arm clamping of the rim is reduced.

3. The combination of claim 1 including roller bearing means supporting the pedal for pivoting, rearwardly of said arm and member.

4. The combination of claim 1 including a heel pad on the plate, and a roller bearing assembly located in association with the heel pad and the rearward end of the pedal, and connected thereto to support the pedal for pivoting.

5. The combination of claim 4 wherein said assembly includes two bearing lugs and tongues extending forwardly and rearwardly of said lugs to connect the bearing assembly to said heel plate and to said pedal.

6. The combination of claim 4 including fasteners rearwardly connecting the heel plate to a base plate defined by the frame.

7. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm to clamp a drum rim, means supporting the arm on the plate to pivot relative thereto, and clamp said rim, and a first adjustable member positioning the arm for pivoting, f) and wherein said first adjustable member being a lever located to pivot said arm as the lever is pivoted.

8. The combination of claim 7 including a rotatably adjustable part acting on the lever to pivot the lever.

9. The combination of claim 7 wherein said lever and said arm extend in relatively angled relation.

10. The combination of claim 9 wherein said arm is located beneath the pedal, and said lever extends at one side of a downward projection of the pedal.

11. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) the frame including a base plate, there being a clamp arm to clamp a drum rim, means supporting the arm on the plate to pivot relative thereto, and clamp said rim, and a first adjustable member positioning the arm for pivoting, f) a second adjustment member to control the position of said arm relative to said plate and rim, whereby the extent of adjustment of the first member to effect arm clamping of the rim is reduced, g) and wherein said second adjustment member being a rotatably adjustable part acting on said arm to vary its range of pivoting by said first adjustable member.

* * * * *